US011052278B2

(12) United States Patent
Brown

(10) Patent No.: US 11,052,278 B2
(45) Date of Patent: Jul. 6, 2021

(54) PIPE EXERCISE DEVICE

(71) Applicant: Micah Brown, Bakersfield, CA (US)

(72) Inventor: Micah Brown, Bakersfield, CA (US)

( * ) Notice: Subject to any disclaimer, the term of this patent is extended or adjusted under 35 U.S.C. 154(b) by 49 days.

(21) Appl. No.: 16/178,956

(22) Filed: Nov. 2, 2018

(65) Prior Publication Data

US 2019/0262656 A1 Aug. 29, 2019

Related U.S. Application Data

(60) Provisional application No. 62/634,433, filed on Feb. 23, 2018.

(51) Int. Cl.

| | |
|---|---|
| ***A63B 21/075*** | (2006.01) |
| ***A63B 21/00*** | (2006.01) |
| ***A63B 21/072*** | (2006.01) |
| ***A63B 21/06*** | (2006.01) |

(52) U.S. Cl.

CPC ..... *A63B 21/075* (2013.01); *A63B 21/0603* (2013.01); *A63B 21/0724* (2013.01); *A63B 21/4035* (2015.10)

(58) Field of Classification Search

CPC ..... A63B 21/075; A63B 21/4035; A63B 21/0603; A63B 21/072; A63B 21/0724; A63B 1/00; A63B 21/0004; A63B 21/00061; A63B 21/00058; A63B 21/00065; A63B 21/06; A63B 21/0601–0603

See application file for complete search history.

(56) References Cited

U.S. PATENT DOCUMENTS

| | | | | |
|---|---|---|---|---|
| 980,025 | A | 12/1910 | Titus | |
| 1,552,073 | A * | 9/1925 | Mansfeldt | A63B 21/045 482/50 |
| 3,311,374 | A | 3/1967 | Wittenberg et al. | |
| 4,199,140 | A | 4/1980 | Ferretti | |
| 5,752,903 | A | 5/1998 | Chang | |
| 7,758,477 | B2 * | 7/2010 | Prenatt | A63B 21/0603 215/379 |
| 8,727,951 | B2 * | 5/2014 | Jones | A63B 21/0602 482/93 |
| 8,951,173 | B2 * | 2/2015 | Kovach | A63B 21/0004 482/110 |
| 9,526,941 | B2 * | 12/2016 | Wu | A63B 21/0728 |
| 9,550,088 | B2 * | 1/2017 | Coompol | A63B 21/0722 |
| 10,343,009 | B2 * | 7/2019 | Peyton | A63B 21/0605 |

(Continued)

*Primary Examiner* — Megan Anderson
*Assistant Examiner* — Kathleen Vermillera
(74) *Attorney, Agent, or Firm* — Boudwin Intellectual Property; Daniel Boudwin

(57) ABSTRACT

A pipe exercise device designed to allow a user to transport a weight variable exercise device. The pipe exercise device includes an elongated member with an outer shell having a hollow interior designed to receive items therein. The elongated member has an open end disposed opposite a sealed end, wherein the open end is in communication with the hollow interior, such that a weight can be received therethrough to sit within the hollow interior. An end cap is designed to seal the open end, such that the weights therein are removably secured. At least one handle is disposed on the outer shell, such that the user can grasp the pipe exercise device. In this way, a user is able to transport a weight training device that can quickly and simply change the amount of weight used.

15 Claims, 2 Drawing Sheets

(56) References Cited

U.S. PATENT DOCUMENTS

| | | | | |
|---|---|---|---|---|
| 2005/0187075 | A1* | 8/2005 | Bellamy | A63B 21/0004 482/93 |
| 2008/0293552 | A1 | 11/2008 | Barrie et al. | |
| 2012/0283073 | A1* | 11/2012 | Zabel | A63B 21/0603 482/93 |
| 2015/0051053 | A1* | 2/2015 | Conen | A63B 21/075 482/108 |
| 2017/0001060 | A1* | 1/2017 | D'Alesio | A63B 21/4035 |
| 2018/0161618 | A1* | 6/2018 | Viglione | A63B 21/0724 |

* cited by examiner

PIPE EXERCISE DEVICE

CROSS REFERENCE TO RELATED APPLICATIONS

This application claims the benefit of U.S. Provisional Application No. 62/634,433 filed on Feb. 23, 2018. The above identified patent application is herein incorporated by reference in its entirety to provide continuity of disclosure.

BACKGROUND OF THE INVENTION

The present invention relates to exercise devices. More specifically, the invention provides pipe exercise device comprising an elongated member having an outer shell and a hollow interior, wherein an open end, disposed opposite a sealed end, is in communication with the hollow interior and configured to removably secure with an end cap. At least one handle is disposed on the outer shell.

Many people perform strength exercises using a variety of weighted objects, such as barbells or dumbbells. However, while working out it is common for a user to spend time swapping their current exercise device for one of a different weight, depending on the type of exercise they are performing. Locating the desired weight and switching it with the current weight takes up time and energy that the user could spend exercising. Thus, an improved pipe exercise device that allows a user to quickly swap weights and having one or more handles is desired.

SUMMARY OF THE INVENTION

In view of the foregoing disadvantages inherent in the known types of exercise devices now present in the known art, the present invention provides a pipe exercise device wherein the same can be utilized for providing convenience for the user when desiring to transport a weight training device that can quickly and easily change the amount of weight used.

The present system comprises a pipe exercise device. The pipe exercise device comprises an elongated member with an outer shell having a hollow interior configured to receive items therein. The elongated member has an open end disposed opposite a sealed end, wherein the open end is in communication with the hollow interior, such that a weight can be received therethrough to sit within the hollow interior. An end cap is configured to seal the open end, such that the weights therein are removably secured. At least one handle is disposed on the outer shell, such that the user can grasp the pipe exercise device. In this way, a user is able to transport a weight training device that can quickly and simply change the amount of weight used.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
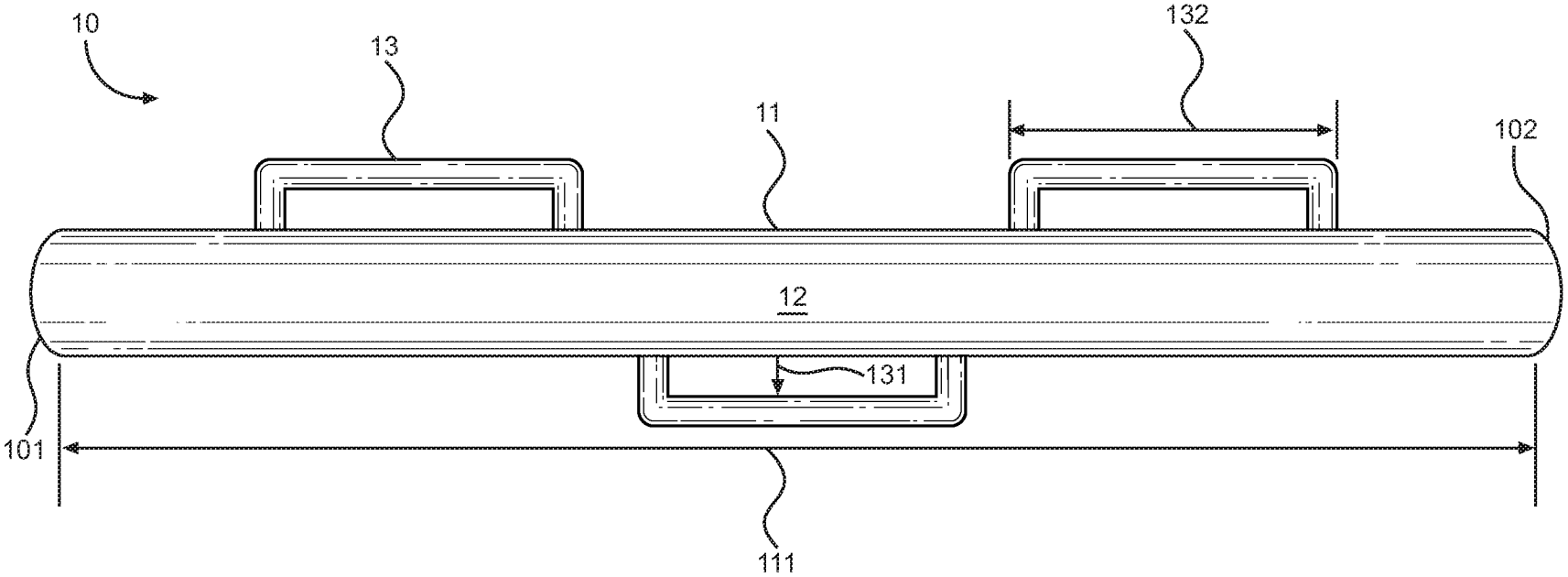
FIG. 1 shows a right-side view of an embodiment of the pipe exercise device.

Reference is made herein to the attached drawings. Like reference numerals are used throughout the drawings to depict like or similar elements of the pipe exercise device. The figures are intended for representative purposes only and should not be considered to be limiting in any respect.

Referring now to FIG. 1, there is shown a right-side view of an embodiment of the pipe exercise device. A pipe exercise device 10 comprises an elongated member 11 having a hollow interior defined by an outer shell 12. In the illustrated embodiment, the outer shell 12 is continuous, such that the surface of the outer shell 12 lacks apertures and thus is not in communication with the hollow interior, thereby preventing any items stored therein from release through the outer shell 12. Further, in the shown embodiment the outer shell 12 is uniform, such that the surface of the outer shell 12 is consistent throughout, allowing the user to grip the elongated member 11 at any point there along. In the illustrated embodiment, the outer shell 12 is smoothly uniform, such that the user can comfortably grip the elongated member 12 without potentially injuring their hand. In other embodiments, however, the outer shell 12 comprises a textured outer surface to increase surface area for frictional engagement, thus allowing the user a more secure grasp when gripping the elongated member 11. In the shown embodiment, the outer shell 12 is composed of a durable metal, such as steel. However, in other embodiments, the outer shell 12 is composed of any suitably sturdy and durable material, such as plastic or tungsten.

The elongated member 11 has a first end and a second end, wherein the first end is an open end 101 and is disposed opposite the second end, wherein the second end is a sealed end 102. The open end 101 is configured to be in communication with the hollow interior such that items within the hollow interior can be accessed through the open end 101. In this way, the hollow interior is configured to accept one or more weighted items, such as sand, therein, thereby allowing the user to selectively control the total weight of the pipe exercise device 10.

The elongated member 11 has a pipe length 111, wherein the pipe length 111 is defined as the distance between the open end 101 and the sealed end 102. In the illustrated embodiment, the hollow interior extends through the pipe length 111 of the elongated member 11 to provide a consistent weight throughout. However, in another embodiment, the hollow interior comprises a length less than the pipe length 111 of the elongated member 11, such that a portion of the interior of the elongated member 11 is filled proximate to the sealed end 102. In this way, the elongated member 11 can be made to have an uneven weight throughout, thereby allowing the user a more challenging workout.

At least one handle 13 is disposed along the outer shell 12. In the illustrated embodiment, a total of three handles 13 are disposed along the outer shell 12, wherein each handle 13 is shaped identically to the remaining handles 13, such that the user can maintain a consistent workout regardless of which handle 13 is used. However, in another embodiment, the handles 13 vary with respect to shape and size, thereby offering the user a greater variety of workouts when using the pipe exercise device 10.

Each handle 13 extends outwardly a protruding distance 131 away from the outer shell 12. The protruding distance 131 of the handle 13 is dimensioned to receive a hand therethrough, and thus varies depending on the intended user of the pipe exercise device 10, such that a greater space is provided for an embodiment intended for an adult male than an embodiment intended for an adult female. In the illustrated embodiment, the protruding distance 131 is equivalent for each handle 13, thereby ensuring a consistent workout for the user regardless of which handle 13 is used. However, in an alternate embodiment the protruding distance 131 varies according the respective handle 13, such that user can choose to vary the difficulty of their exercise routine by choosing which handle 13 to use, as an increased protruding distance 131 would result in a more difficult workout.

Additionally, each handle 13 has a handle length 132, wherein the handle length 132 is defined as the distance between each end of the handle 13 protruding outward from the outer shell 12. Similar to the protruding distance 131, the handle length 132 is dimensioned to receive the hand of the user thereon, such that the user can grip the handle 13 with the entire surface of their hand without being uncomfortably restricted by the handle length 132. Thus, the handle length 132 varies depending on the intended user of the pipe exercise device 10, such that a larger distance is provided for an embodiment intended for an adult male than an embodiment intended for an adult female. However, in an alternate embodiment the handle length 132 is dimensioned to receive both hands of the user thereon, thereby allowing for two-handed exercise applications. In the illustrated embodiment, the handle length 132 is equivalent for each handle 13, thereby ensuring a consistent workout for the user regardless of which handle 13 is used.

Each of the handles 13 is staggered along the elongated member 11, such that each handle 13 is positioned at a discrete distance along the pipe exercise device 10 and extends along the entire pipe length 111. Further, the position of each handle 13 is dependent upon the pipe length 111, such that each handle 13 is positioned at even intervals. Thus, in the illustrated embodiment, the handles 13 each have an equivalent distance between one another. This ensures the pipe exercise device 10 is evenly balanced prior to the inclusion of weights disposed within the hollow interior, as it allows the user to grip any handle 13 of their choosing without concern they pipe exercise device 10 is not evenly balanced.

Figure 2:
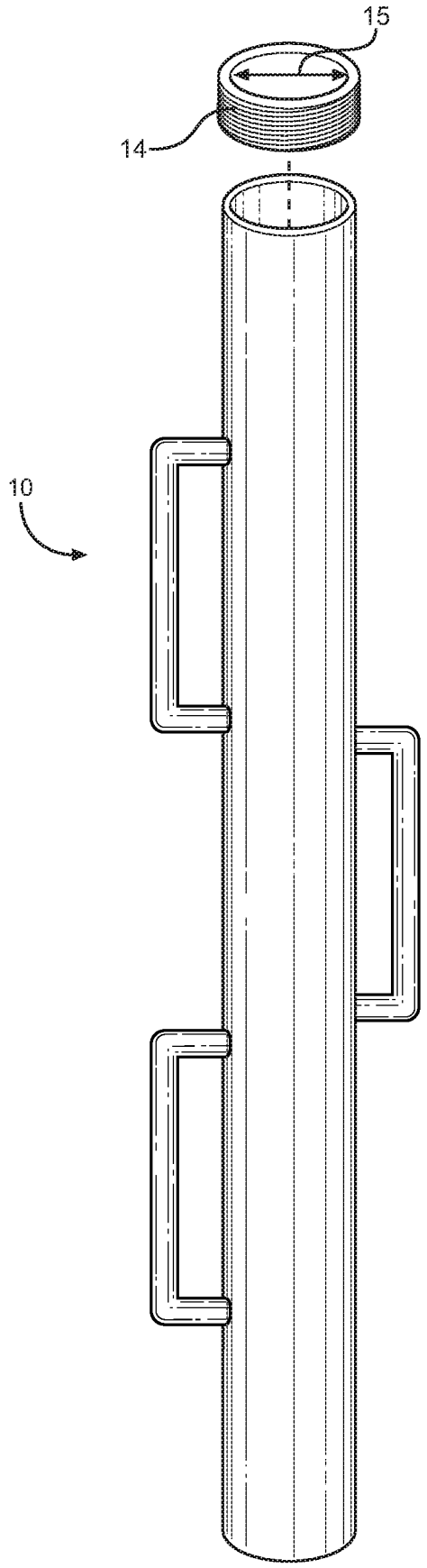
FIG. 2 shows a perspective view of an embodiment of the pipe exercise device installed.

Referring to FIG. 2, there is shown a perspective view of an embodiment of the pipe exercise device. The pipe exercise device 10 further comprises a pipe diameter 15, wherein the pipe diameter 15 is defined as the diameter of the hollow interior. In the illustrated embodiment, the handles are disposed about a perimeter of the pipe exercise device 10, wherein the perimeter is commensurate with a circumference of the pipe exercise device 10. Thus, in the illustrated embodiment, sequential handles are disposed on alternating sides of the outer shell, such that each handle is not sequentially aligned with one another.

The pipe exercise device 10 further comprises an end cap 14 configured to seal the open end of the elongated member. Thus, the end cap 14 has a diameter commensurate with the pipe diameter 15, such that it is dimensioned to removably secure to the open end of the elongated member. In this way, the hollow interior can be filled with a plurality of weights and sealed using the end cap 14, thereby preventing the weights therein from being displaced when the pipe exercise device 10 is used. In the illustrated embodiment, the end cap 14 is threaded, such that the user can remove or apply the end cap 14 through rotation. However, in other embodiments, the end cap 14 is secured via friction fit, or another suitably secure means of fastening.

In operation, a user will fill the hollow interior of the pipe exercise device 10 with the desired amount of weight through the open end of the elongated member, and removably secure the end cap 14 to open end. The user can then grasp one or more handles disposed along the outer shell of the elongated member and thereby utilize the pipe exercise device 10 to exercise, such as through lifting the pipe exercise device 10 above their head. Should the user wish to adjust the weight used, they can remove the end cap 14 and alter the weight disposed therein. In this way, the user can travel and use a single device to perform an exercise routine using a variety of weights.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pipe exercise device, comprising:

an elongated member having an outer shell defining a hollow interior;

the elongated member having an open end disposed opposite a sealed end;

the hollow interior configured to receive items therein;

the open end in communication with the hollow interior;

an end cap configured to seal the open end;

a plurality of handles disposed on the outer shell;

the plurality of handles consisting of a first handle, a second handle and a third handle;

the first handle and the second handle being disposed on a first side of the elongated member;

the third handle being disposed on a second side of the elongated member;

the first handle, the second handle and the third handle being parallel in alignment.

2. The pipe exercise device of claim 1, wherein the plurality of handles are radially staggered along a length of the elongated member.

3. The pipe exercise device of claim 2, wherein each of the plurality of handles is positioned equidistant from a corresponding proximate handle of the plurality of handles.

4. The pipe exercise device of claim 1, wherein the plurality of handles are staggered along a singular plane of the elongated member.

5. The pipe exercise device of claim 1, wherein each of the plurality of handles extends an equivalent distance away from the outer shell of the pipe exercise device.

6. The pipe exercise device of claim 1, wherein each of the plurality of handles is of an equivalent length.

7. The pipe exercise device of claim 1, wherein each of the plurality of handles is rectangularly shaped.

8. The pipe exercise device of claim 1, wherein each of the plurality of handles is not sequentially aligned with another.

9. The pipe exercise device of claim 1, wherein a length of each of the plurality of handles is disposed along a length of the outer shell.

10. The pipe exercise device of claim 1, wherein the outer shell is continuous, such that an exterior surface of the outer shell lacks apertures.

11. The pipe exercise device of claim 1, wherein a protruding distance varies between each of the plurality of handles.

12. The pipe exercise device of claim 1, wherein a diameter of the end cap is commensurate with a diameter of the hollow interior.

13. The pipe exercise device of claim 1, wherein the end cap is removably securable to the open end.

14. The pipe exercise device of claim 1, wherein the end cap is threadably securable to the open end.

15. A pipe exercise device, consisting of:

an elongated member having an outer shell defining a hollow interior;

the elongated member having an open end disposed opposite a sealed end;

the hollow interior configured to receive items therein;

the open end in communication with the hollow interior;

an end cap configured to seal the open end;

a plurality of handles disposed on the outer shell;

the plurality of handles consisting of a first handle, a second handle and a third handle;

the first handle and the second handle being disposed on a first side of the elongated member;

the third handle being disposed on a second side of the elongated member;

the first handle, the second handle and the third handle being parallel in alignment.

* * * * *